US007988506B2

(12) United States Patent
Peterson et al.

(10) Patent No.: US 7,988,506 B2
(45) Date of Patent: Aug. 2, 2011

(54) DUAL FEMALE TERMINAL WITH TWO CONTACT PORTIONS EACH HAVING AN APERTURE AND A MALE TERMINAL DISPOSED IN APERTURES OF BOTH CONTACT PORTIONS

(75) Inventors: Todd R. Peterson, New Boston, MI (US); Ketan Adhvaryu, Sterling Heights, MI (US); Ramon B. Jaramillo, Sterling Heights, MI (US)

(73) Assignee: BorgWarner, Inc., Auburn Hills, MI (US)

( * ) Notice: Subject to any disclaimer, the term of this patent is extended or adjusted under 35 U.S.C. 154(b) by 21 days.

(21) Appl. No.: 12/442,152

(22) PCT Filed: Oct. 12, 2007

(86) PCT No.: PCT/US2007/021775

§ 371 (c)(1), (2), (4) Date: Dec. 17, 2009

(87) PCT Pub. No.: WO2008/045524

PCT Pub. Date: Apr. 17, 2008

(65) Prior Publication Data

US 2010/0093228 A1 Apr. 15, 2010

Related U.S. Application Data

(60) Provisional application No. 60/851,155, filed on Oct. 12, 2006.

(51) Int. Cl.
*H01R 11/11* (2006.01)

(52) U.S. Cl. ..... 439/857

(58) Field of Classification Search ..... 439/857, 439/862, 849, 842, 747, 682, 404, 499
See application file for complete search history.

(56) References Cited

U.S. PATENT DOCUMENTS

| | | | | |
|---|---|---|---|---|
| 3,537,062 | A * | 10/1970 | Niskin | 439/205 |
| 4,310,210 | A * | 1/1982 | Takahashi et al. | 439/247 |
| 5,383,800 | A * | 1/1995 | Saka et al. | 439/787 |
| 5,632,652 | A | 5/1997 | Zell et al. | |
| 6,394,829 | B1 | 5/2002 | Patterson et al. | |
| 6,896,549 | B2 | 5/2005 | Feuerreiter et al. | |
| 6,979,222 | B2 * | 12/2005 | Comini | 439/404 |
| 7,771,243 | B2 * | 8/2010 | Peterson et al. | 439/857 |

FOREIGN PATENT DOCUMENTS

| | | | |
|---|---|---|---|
| JP | 11067311 | A | 5/1999 |
| JP | 8124639 | A | 5/2002 |

* cited by examiner

*Primary Examiner* — Chandrika Prasad
(74) *Attorney, Agent, or Firm* — Warn Partners, P.C.

(57) ABSTRACT

The invention is directed to a plug-in connector arrangement (10) having a dual female terminal (22). The dual female terminal (22) has a first contact portion (24) with an aperture (26) formed the first contact portion (24) and a second contact portion (30) with an aperture (32) formed through the second contact portion (30). The first contact portion (24) and second contact portion (30) are connected together. A connector (40) having a male terminal (44) on one is disposed through said aperture (26) of the first contact portion (24) and said aperture (32) of the second contact portion (30). The second end (48) of the connector (40) is configured to be connected to a power source.

17 Claims, 4 Drawing Sheets

DUAL FEMALE TERMINAL WITH TWO CONTACT PORTIONS EACH HAVING AN APERTURE AND A MALE TERMINAL DISPOSED IN APERTURES OF BOTH CONTACT PORTIONS

CROSS-REFERENCE TO RELATED APPLICATIONS

This application claims the benefit of U.S. Provisional Application No. 60/851,155, filed Oct. 12, 2006. The disclosure of the above application is incorporated herein by reference.

FIELD OF THE INVENTION

The present invention is directed to a connector and terminal arrangement.

BACKGROUND OF THE INVENTION

M-slots (along with I/H slots) are mechanical connections that are used in the industry for creating an electrical connection. A typical M-slot has a female member (e.g., the M-slot terminal) that is configured for receiving a male terminal, known as a blade terminal. When the blade terminal is inserted into M-slot the electrical connection is complete. The use of the M-slot terminal provides a clean and reliable electrical connection for assembling a circuit, such as a lead frame to a device. M-slots are also ideal because their small design allows for smaller overall package size.

With regard to secondary air pumps, power is traditionally supplied through the use of soldering connections between the actuator device and an electrical source. This increases assembly time and decreases quality. It is desirable to develop a faster and more efficient connection between a power source and the actuator device for secondary air pumps.

SUMMARY OF THE INVENTION

The invention is directed to a plug-in connector arrangement having a dual female terminal. The dual female terminal has a first contact portion with an aperture formed through the first contact portion and a second contact portion with an aperture formed through the second contact portion. The first contact portion and second contact portion are connected together. A connector having a male terminal on one end is disposed through the apertures of the first and second contact portions. The second end of the connector is configured to be connected to a power source.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figure 1:
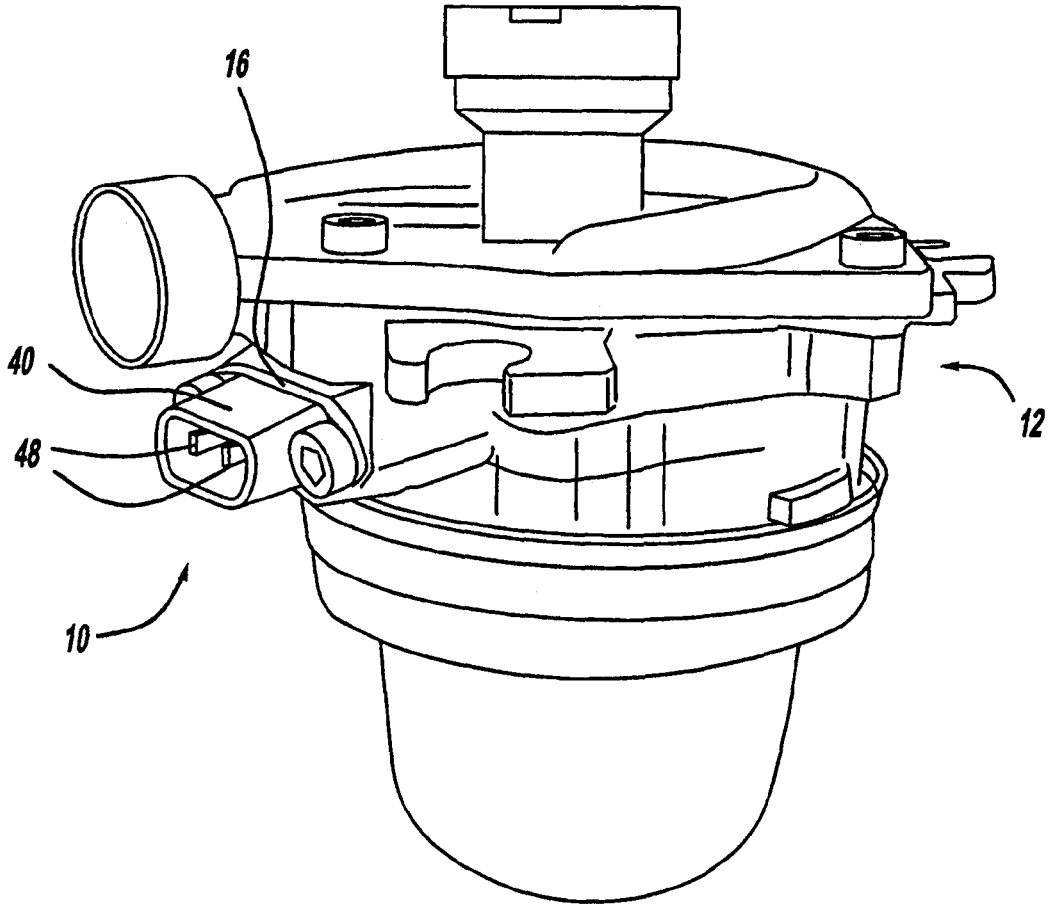
FIG. 1 is a perspective view of a secondary air pump having the plug in connector arrangement connected.

The following description of the preferred embodiment(s) is merely exemplary in nature and is in no way intended to limit the invention, its application, or uses.

Referring now to FIGS. 1-5 a plug in connector arrangement 10 is shown. The plug in connector arrangement 10 is incorporated on a secondary air pump housing 12 having an interior chamber 14 for containing an actuator 18 for operating the secondary air pump. The secondary air pump housing 12 has an opening 16 that extends between the interior chamber 14 and the exterior of the pump housing 12.

Figure 2:
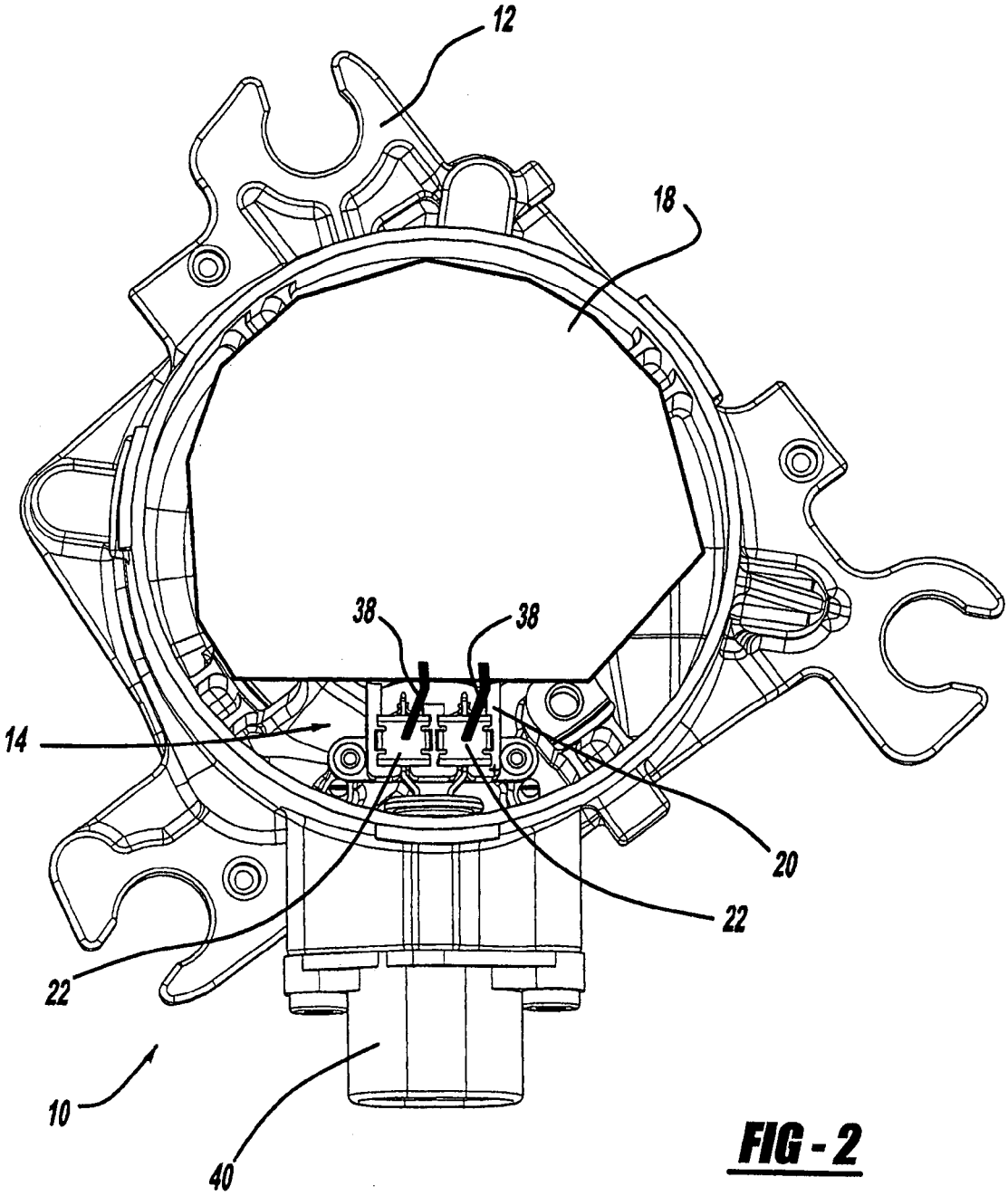
FIG. 2 is a cross-sectional perspective view of the secondary air pump housing with the plug in connector arrangement.
Figure 3:
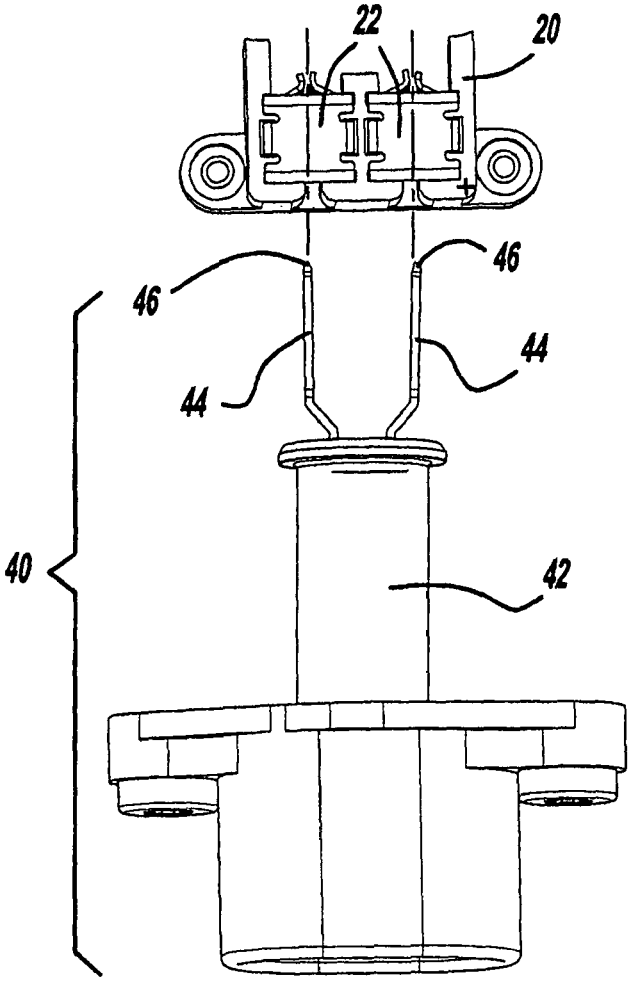
FIG. 3 is an exploded perspective view of the dual female terminals and the connector.
Figure 4:
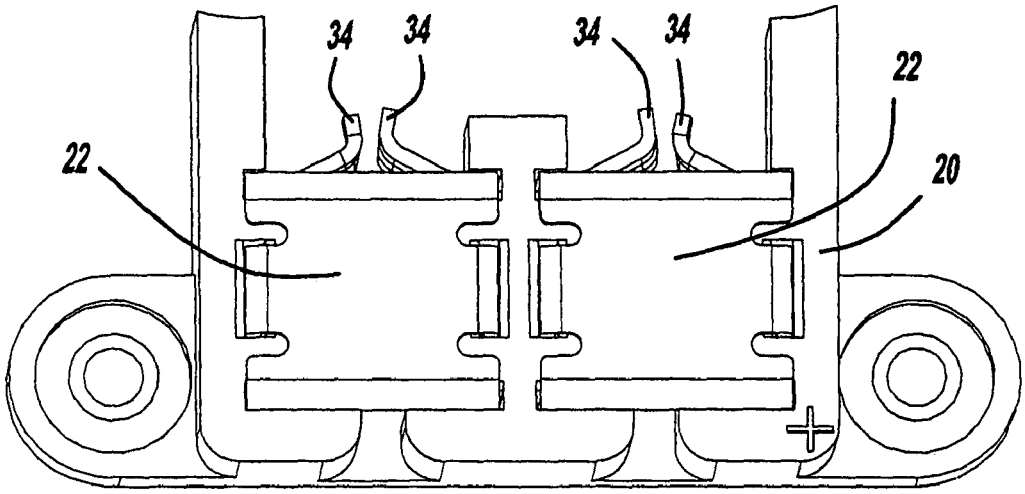
FIG. 4 is an exploded sectional view of the dual female terminals with a plastic form.
Figure 5:
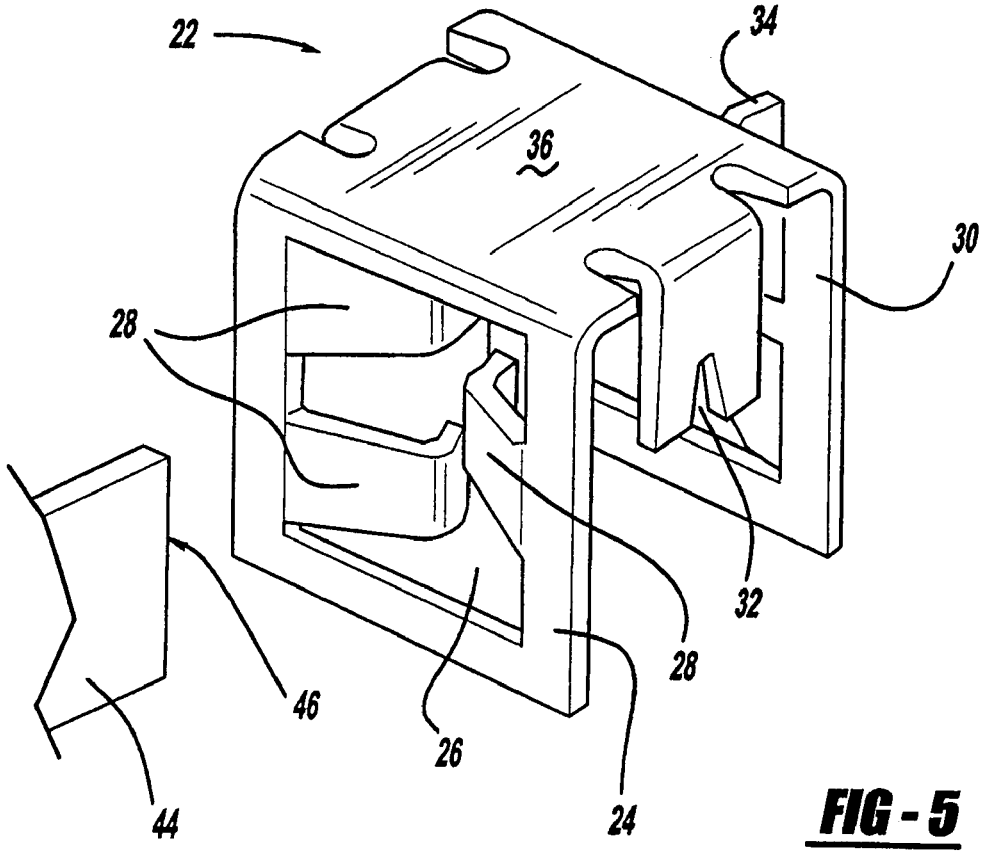
FIG. 5 is a perspective side view of a single dual female terminal with the end of a male terminal positioned prior to engagement.

Also contained within the interior chamber 14 is a plastic form 20 that is aligned with the opening 16. The plastic form 20 is configured to receive and hold one or more dual female terminals 22. The embodiment shown in FIGS. 2-4 depicts the use of two dual female terminals 22; however, it is within the scope of this invention for a lesser or greater number of dual female terminals to be used depending upon the needs of a particular application. For example, an actuator that requires different signals or an increased current can use more dual female terminals. The dual female terminals 22 are held in the plastic form 20 in operable alignment with the opening 16 of the pump housing 12.

Each dual female terminal 22 has a first contact portion 24 having an aperture 26 with one or more flanges 28 extending into the aperture 26 for forming a clip. Each individual dual female terminal 22 also has a second contact portion 30 having an aperture 32 with one or more flanges 34 extending into the aperture 32 for also forming a clip. The first contact portion 24 and second contact portion 30 are connected together by a bridge 36 that can either be welded to first and second contact portions 24, 30 or can be integrally formed with the first and second contact portions 24, 30. The apertures 26, 32 are aligned for receiving the end 46 of the male terminal 44. In order to connect the dual female terminals 22 to the actuator 18 a solder and wire 38 can be connected to the bridge 36 or any of the contact portions 24, 30 at one end and to the actuator 18 at another end.

A connector shown generally at 40 has a body 42 that encases one or more male terminals 44 having one end 46 connectable with one dual female terminal 22. A second end 48 of each male terminal 44 is located at an opposite end of the body 42 and is connectable to a power or signal source. The male terminals 44 are blade terminals. The male terminals 44 are connected to the dual female terminals 22 by being positioned through the opening 16 in the pump housing 12. The opening 16 is shaped to receive the body 42 of the connector 40 and allow the male terminals 44 to plug into the dual female terminals 22. The one end 46 of each terminal 44 is disposed through the first contact portion 24 and second contact portion 30 of a dual female terminal 22. The flanges 28, 34 form a clip that exerts pressure on the male terminal 44 to hold the terminal in place within the apertures 26, 32. The body 42 of the connector can be fastened to the pump housing 12 using fasteners, adhesives or other suitable means. The invention allows for the quick connection of a power source to an actuator that can be accomplished with ease during assembly.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A plug-in connector arrangement comprising:

a dual female terminal having a first contact portion with an aperture formed through said first contact portion, a second contact portion with an aperture formed through said second contact portion, wherein said first contact portion and said second contact portion are connected together; and a connector having a male terminal on one end for being disposed through said aperture of said first contact portion and said aperture of said second contact portion and a second end of said connector is configured to be connected to a power source.

2. The plug-in connector arrangement of claim 1 further comprising:

a connection between said dual terminal and a device, wherein said dual terminal supplies a signal to said device that is received from said connector, wherein said first contact portion and said second portion are M-slot terminals and said male terminal is a blade terminal.

3. The plug-in connector arrangement of claim 2 wherein said first contact portion has two or more flanges positioned in said aperture of said first contact portion to form a clip;

two or more flanges positioned in said aperture of said second contact portion to form a clip, wherein said clip of said first contact terminal and said clip of said second contact terminal form a contact surface when said blade is disposed through said aperture of said first contact portion and said second contact portion.

4. The plug-in connector arrangement of claim 1 wherein said dual terminal is arranged in the shape of a U wherein said second contact portion is aligned with said first contact portion in a substantially parallel manner.

5. The plug-in connector arrangement of claim 4 wherein said dual female terminal is held in place by a plastic form.

6. The plug-in connector arrangement of claim 1 further comprising a connector body enclosing portions of the male terminal and leaving said one end and said second end of said male terminal exposed.

7. A plug-in connector arrangement comprising:

a secondary air pump housing having an interior chamber with an opening disposed through said housing;

a device connected in said interior chamber;

a dual female terminal mounted in said interior chamber, wherein said dual female terminal has a first contact portion with an aperture formed through said first contact portion, a second contact portion with an aperture formed through said second contact portion, wherein said first contact portion and said second contact portion are connected together; and a connector sealingly disposed through said opening in said secondary air pump housing, said connector has a male terminal on one end for being disposed through said aperture of said first contact portion and said aperture of said second contact portion and a second end of said connector is positioned outside of said secondary air pump housing for connecting said connector to a power source.

8. The plug-in connector arrangement of claim 7 further comprising:

a connection between said dual terminal and said device, wherein said dual terminal supplies a signal to said device that is received from said connector, wherein said first contact portion and said second portion are M-slot terminals and said male terminal is a blade terminal.

9. The plug-in connector arrangement of claim 7 wherein said first contact portion has two or more flanges positioned in said aperture of said first contact portion to form a clip;

two or more flanges positioned in said aperture of said second contact portion to form a clip, wherein said clip of said first contact terminal and said clip of said second contact terminal form a contact surface when said blade is disposed through said aperture of said first contact portion and said second contact portion.

10. The plug-in connector arrangement of claim 7 wherein said dual terminal is arranged in the shape of a U wherein said second contact portion is aligned with said first contact portion in a generally parallel manner.

11. The plug-in connector arrangement of claim 7 wherein said dual female terminal is held in place by a plastic form positioned inside of said interior chamber.

12. The plug-in connector arrangement of claim 7 further comprising a connector body enclosing portions of the male terminal and leaving said one end and said second end of said male terminal exposed, wherein said connector body is disposed through said opening.

13. A plug-in connector arrangement comprising:

a secondary air pump housing having an interior chamber with an opening disposed through said housing;

an actuator connected in said interior chamber;

a dual female terminal mounted in said interior chamber, wherein said dual female terminal has a first contact portion with an aperture formed through said first contact portion, a second contact portion with an aperture formed through said second contact portion, wherein said first contact portion and said second contact portion are connected together; and a connector body disposed through said opening in said secondary air pump housing;

one or more male terminals extending through said connector body, wherein each of said one or more male terminals has a first end disposed through said aperture of said first contact portion and said aperture of said second contact portion and a second end of said connector and a second end of each said one or more male terminals is positioned outside of said secondary air pump housing for connecting said connector to a power source.

14. The plug-in connector arrangement of claim 13 further comprising:

a connection between said dual terminal and said device, wherein said dual terminal supplies a signal to said device that is received from said connector, wherein said first contact portion and said second portion are M-slot terminals and said one or more male terminal are blade terminals.

15. The plug-in connector arrangement of claim 14 wherein said first contact portion has two or more flanges positioned in said aperture of said first contact portion to form a clip;

two or more flanges positioned in said aperture of said second contact portion to form a clip, wherein said clip of said first contact terminal and said clip of said second contact terminal form a contact surface when said blade is disposed through said aperture of said first contact portion and said second contact portion.

16. The plug-in connector arrangement of claim 13 wherein said dual terminal is arranged in the shape of a U wherein said second contact portion is aligned with said first contact portion in a substantially parallel manner.

17. The plug-in connector arrangement of claim 13 wherein said dual female terminal is held in place by a plastic form positioned inside of said interior chamber.

* * * * *